US008826568B1

(12) United States Patent
Flatley

(10) Patent No.: US 8,826,568 B1
(45) Date of Patent: Sep. 9, 2014

(54) LACING SYSTEM

(71) Applicant: Thomas J. Flatley, East Greenwich, RI (US)

(72) Inventor: Thomas J. Flatley, East Greenwich, RI (US)

( * ) Notice: Subject to any disclaimer, the term of this patent is extended or adjusted under 35 U.S.C. 154(b) by 0 days.

(21) Appl. No.: 13/987,531

(22) Filed: Aug. 5, 2013

(51) Int. Cl.
*A43C 11/00* (2006.01)
*A43C 1/00* (2006.01)
*A43C 5/00* (2006.01)

(52) U.S. Cl.
CPC .... *A43C 1/00* (2013.01); *A43C 5/00* (2013.01)
USPC ..... 36/50.1; 24/715.1; 24/714.6; 24/714.9

(58) Field of Classification Search
CPC ..... A43C 5/00; A43C 3/00
USPC ..... 24/715.1, 714.6, 714.9; 36/50.1
See application file for complete search history.

(56) References Cited

U.S. PATENT DOCUMENTS

| | | | | | |
|---|---|---|---|---|---|
| 887,942 | A * | 5/1908 | Houghland | ..... | 24/714.1 |
| 1,246,724 | A * | 11/1917 | Daggett | ..... | 24/715.1 |
| 1,493,345 | A * | 5/1924 | Kern | ..... | 24/714.6 |
| 1,995,243 | A * | 3/1935 | Clarke | ..... | 24/713.3 |
| 7,392,573 | B2 * | 7/2008 | Issler | ..... | 24/714.6 |

FOREIGN PATENT DOCUMENTS

GB 23766 * 0/1912

* cited by examiner

*Primary Examiner* — Ted Kavanaugh
(74) *Attorney, Agent, or Firm* — Robert J. Doherty

(57) ABSTRACT

A lacing system and unique eyelet construction adapted for use therein including an eyelet formed from wire or rod stock preferably of circular cross-section that is progressively formed into a generally U-shaped configuration having a semicircular central portion and a pair of legs terminating in flattened ears adapted for connection to a shoe flap.

5 Claims, 6 Drawing Sheets

LACING SYSTEM

BACKGROUND OF THE INVENTION

This invention pertains to lacing systems for shoes and boots especially high top athletic, work and hiking boots that are currently extremely popular. Such boots include a pair of flaps in which openings are formed longitudinally therealong such that when the flaps are positioned in opposition to each other and an elongated lacing member which is threaded across the opening therebetween and when tightened, the flaps will move closer together to assume the desired comfortable fit and tightness of the wearer. The lacing is then tied or otherwise fixed in position to maintain the desired snugness and support. Generally, the flap openings are fitted with eyelets or guides, e.g., metal or plastic grommets, to reduce the friction between the lacing and the flap openings and to prevent excessive wear to the flaps and/or lacings. Some current boot designs also utilize triangular or other open shaped clasps or hooks that are fixed to the upper surface of the flaps as by sewing and through which the lacing is passed in the normal crisscross fashion.

These aforementioned lacing systems display a number of shortcomings in that these lacing systems tend to produce fairly high frictional forces between the inner surfaces of the grommets or clasps and the lacing itself. Particularly in the case of irregularly shaped guides, these lacing systems force the lacing against the same surface area during the tightening action and thus tend to increase wear on the lacing especially if the contact surface is at all rough or has an irregularity such as a break or chip. Grommets and eyelets also restrict the diameter of the lacing available for use.

Accordingly, it would be desirable if the forces between the guides and lacing could be of a shape that would permit the lacing to contact a greater portion of the guide itself and to form the eyelet of a shape that even further reduces the frictional contact between the lacing and the inner contact surface of the guide regardless of the guide's geometric configuration.

Another desirable feature would be to reduce or eliminate the sliding contact between the lacing and the upper flap surfaces thus contributing to a desirable feature of being able to tighten the lacing and thus the flaps by pulling directly upward without having to readjust the spacing and tension between oppositely positioned guides mounted on or otherwise attached to the flaps.

These and other objects of the invention are accomplished by the provision of guides that include both a generally semicircular lacing contact surface area and which are additionally circular in cross-section.

Still further objects of the invention are accomplished by providing guides of overall U-shaped configuration having legs and a central lacing engagement surface of essentially semicircular configuration and wherein each such guide is oriented in a plane positioned normal to the flap to which the guide is connected such that the central surface projects into the flap spacing area thus minimizing and/or eliminating the contact between the lacing and the flaps.

Further objects of the invention are also accomplished by providing an improved lacing system for a shoe or boot having a tongue and a pair of closure flaps overlying said tongue wherein each of said flaps in turn having an inner edge wherein said inner edges are disposed in separated opposition to each other so as to define a variable width closure space, each of said flaps including a plurality of extended eyelets mounted in longitudinal separation thereon wherein said eyelets extend into said closure space, overlie said tongue and are positioned in lateral opposition to each other, each of said eyelets of an overall U-shaped configuration having a central semicircular portion defining a low friction inner surface lace engaging surface and a pair of leg portions each in turn terminating in a connector portion for connecting said eyelet to said flap, each of said eyelets formed from an integral length of wire or rod of circular cross-sectional configuration which is progressively bent and shaped to form the central and connector portions thereof, said system enabling a lacing having a longitudinal strand-like body and opposed ends to be crisscross threaded through said eyelets such that force applied to the lacing ends will enable the lacing body to smoothly engage the inner surface of said central portion and enable no snag tightening and loosening of said flaps.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
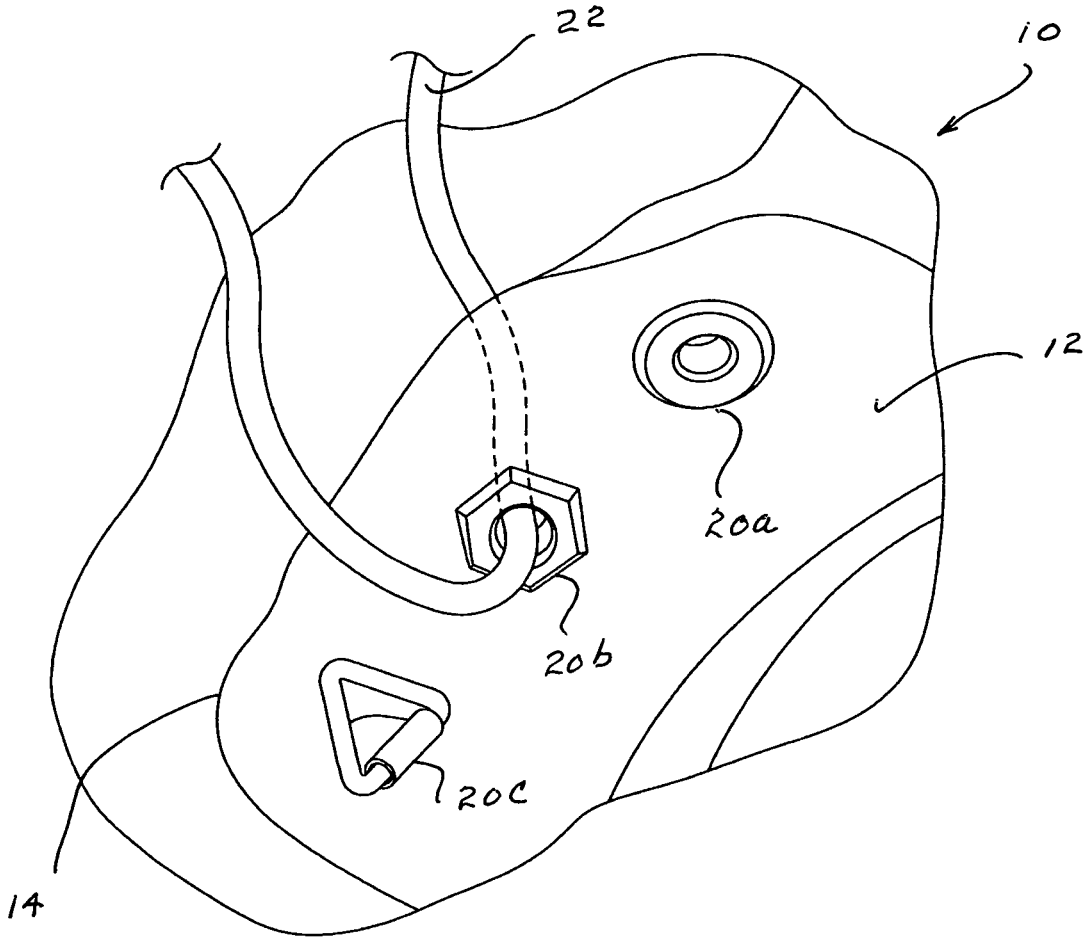
FIG. 1 (PRIOR ART)
FIG. 1 is a partial perspective view showing a boot flap portion utilizing several forms of prior art eyelet forms.
Figure 9:
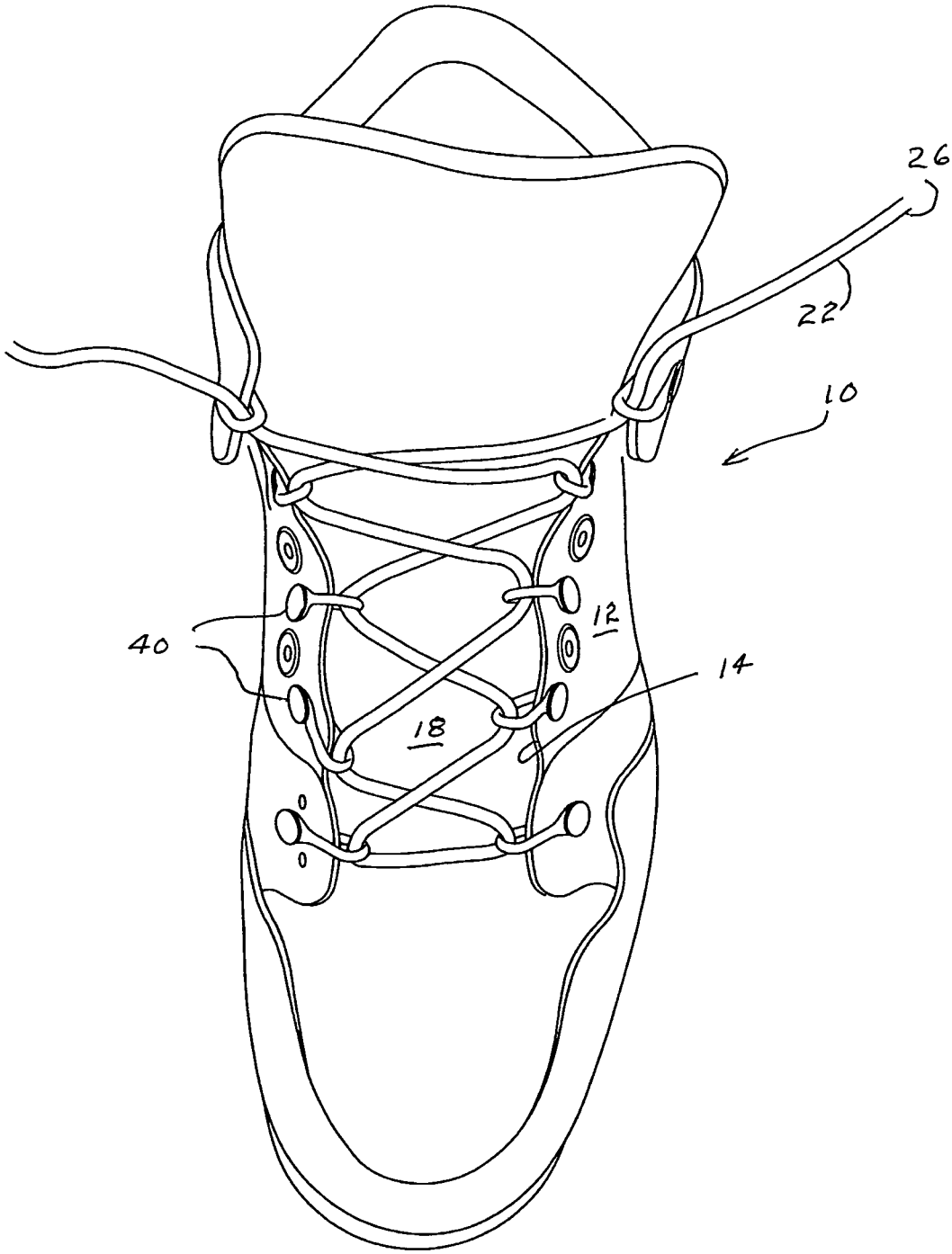
FIG. 9 is a partial top plan view of a boot having the guides of the present invention attached thereto in an open flap position.
Figure 10:
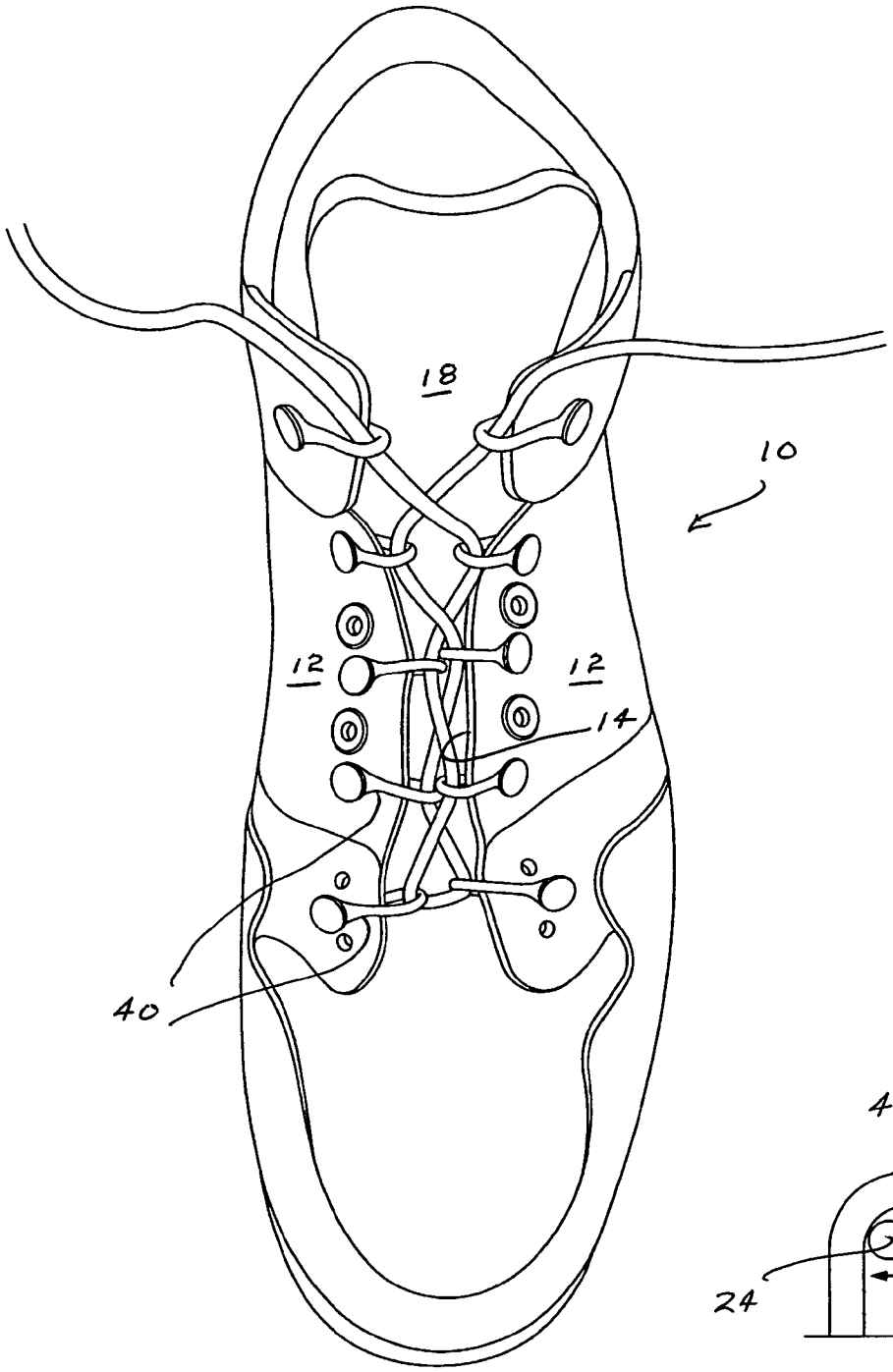
FIG. 10 is a partial top plan view of the boot shown in FIG. 9 in a closed or tightened position.

Turning now to the drawings and in particular FIG. 1, a portion of a high top boot 10 is shown with three alternate conventional lacing options. The boot 10 has a pair of closure flaps 12 (only one of which is shown in FIG. 1) that include opposed edges 14 which define a closure gap 16 (see FIGS. 9, 10) therebetween. A tongue 18 is normally disposed in a position to underlay the gap 16. The flaps include an upper surface 13 and a series of openings 20 that are formed longitudinally along each flap 12 and through which a lace 22 having an elongated strand-like body 24 and terminal ends 26 is threaded generally in crisscross fashion, that is, the lacing passes through an opening 20 of one flap 12, across the tongue's upper surface, and then passed over a portion of the opposite flap 12 such as is well known and depicted in U.S. Pat. No. 1,548,407 issued Aug. 4, 1925. In some cases, the openings can take the form of fingers or hooks that attach to the flaps and through which the lacing is threaded such as the framework 11 shown in U.S. Pat. No. 5,761,77 issued Jun. 9, 1998 to Leick. Other known opening variations are shown in FIG. 1 and include an opening 20*a* reinforced with a circular grommet, an opening 20*b* in the form of an open nut to convey a rugged appearance and an opening 20*c* in the form of a triangular clasp. All these known openings for lacing receipt include one or more of the previously discussed drawbacks.

Figure 2:
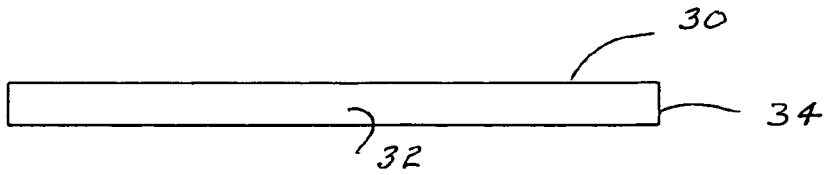
FIG. 2 is a top plan view of a section of a malleable metal rod or wire from which one form of the present guide is formed.

Turning now to FIGS. 2-6 of the drawings, one form of the eyelet generally referred to above as an opening is depicted that reduces and/or eliminates the above discussed prior art drawbacks. In FIG. 2, a length of preform 30 of solid circular wire or rod stock of a suitable malleable metal such as copper or brass is shown. The preform may be of any suitable length and thickness such as the eyelet formed therefrom that fits the boot to which the eyelet will be affixed as will hereinafter be shown. A preform length of 1.6 inches of 0.10-inch diameter copper wire has been found suitable for this purpose but other lengths may be utilized.

Figure 3:
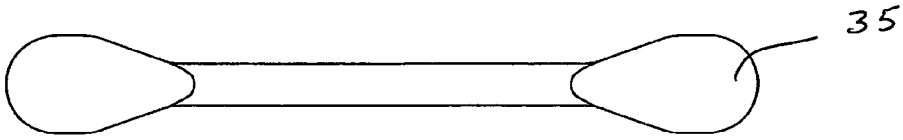
FIGS. 3 and 4 are progressive top plan views showing the manner in which the wire or rod section shown in FIG. 2 is manipulated as by a progressive die to form an interim guide shape.
Figure 4:
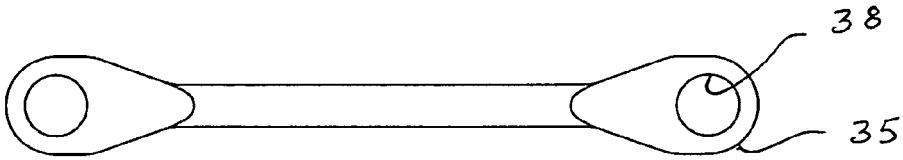
Figure 5:
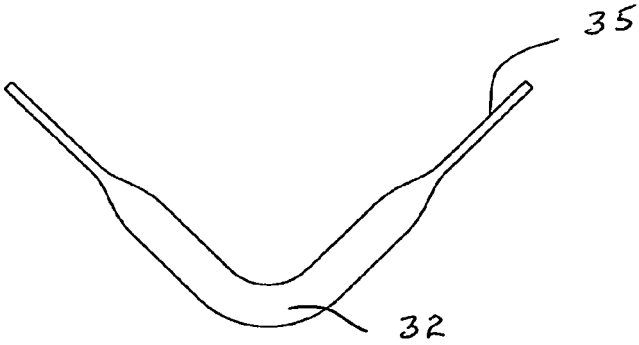
FIGS. 5 and 6 are progressive front views showing the manner in which the interim guide shape shown in FIG. 4 is further bent to form the final guide shape.
Figure 6:
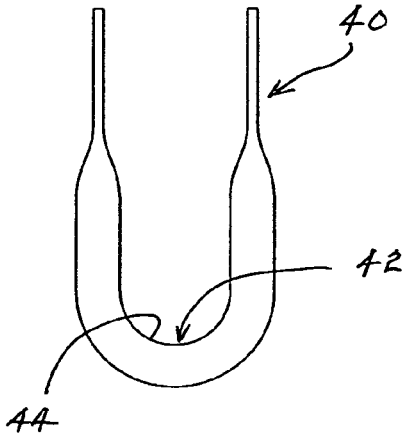
Figure 7:
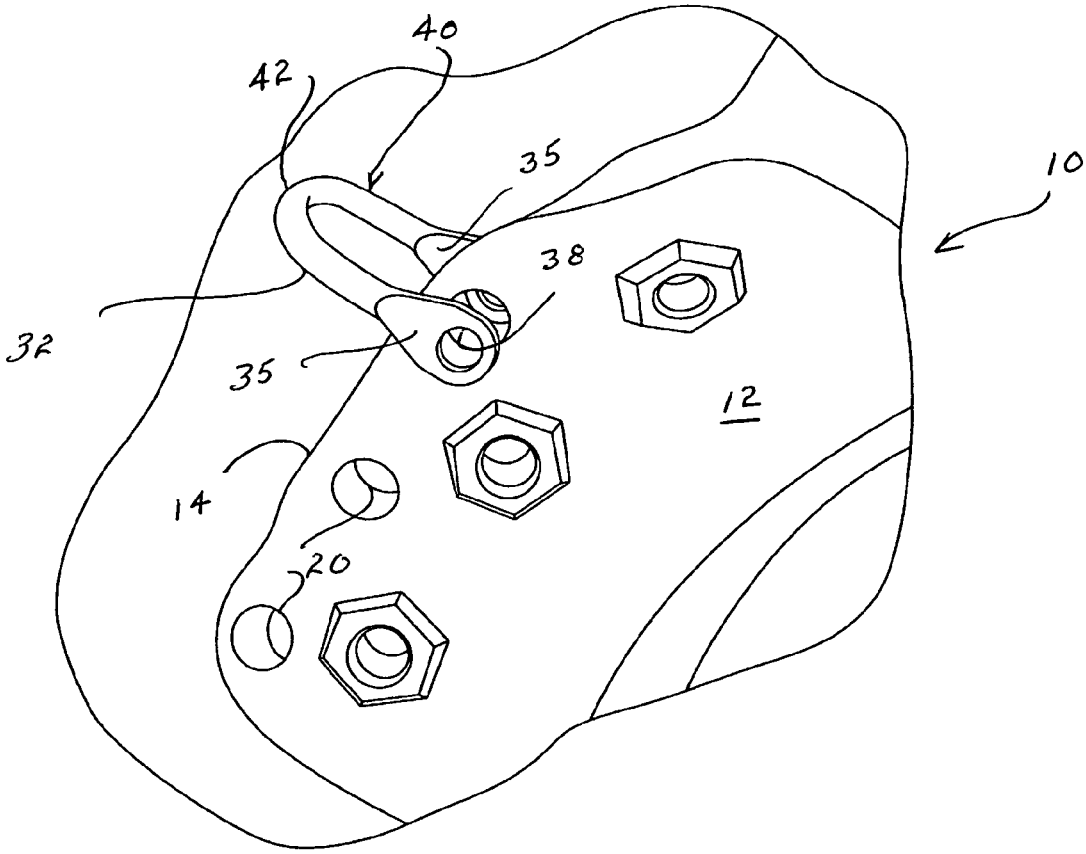
FIG. 7 is a partial perspective view on which one of the guides of the present invention is placed for attachment to a boot flap.
Figure 8:
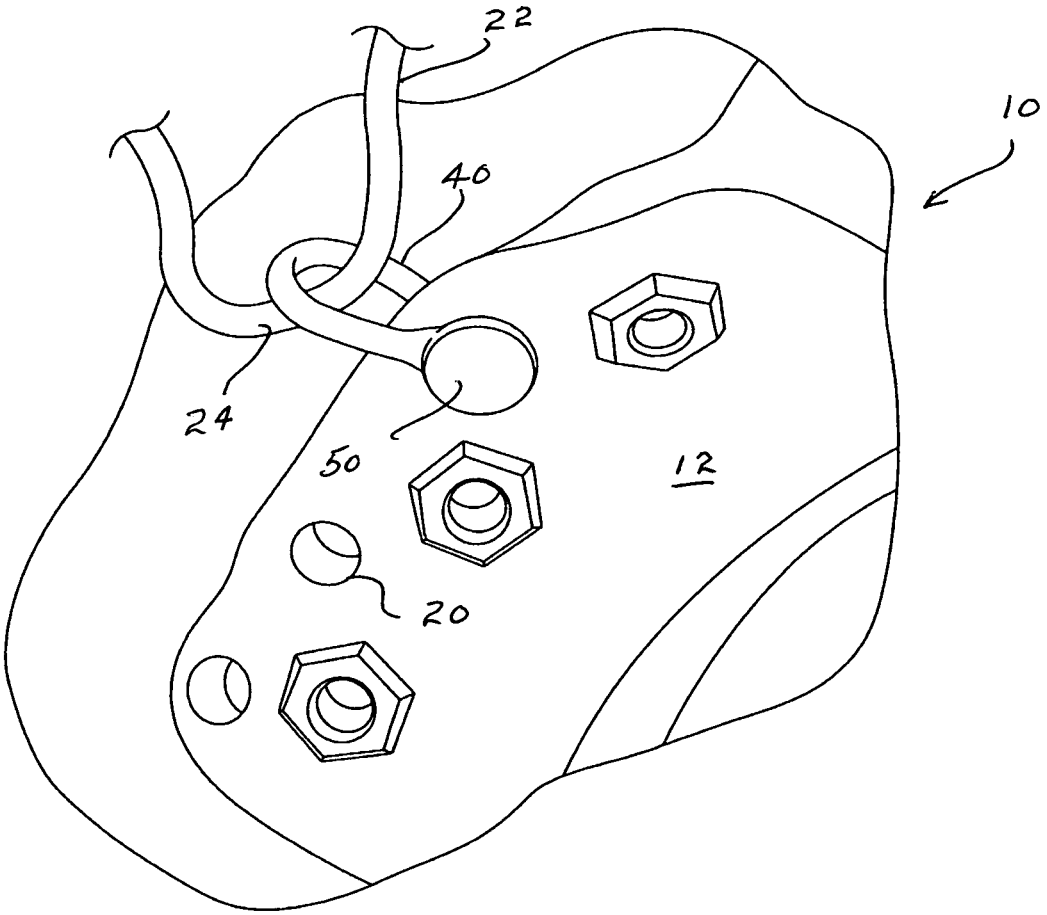
FIG. 8 is a partial perspective view showing one of the guides attached to a boot flap as by a rivet.
Figure 10A:
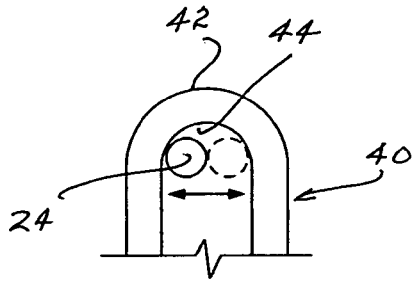
FIG. 10A is an enlarged sectional view of FIG. 10.

The preform 30 shown in FIG. 2 that includes a central body 32 and terminal ends 34 is then progressively reshaped by suitable tooling to the preform stage shown in FIG. 3 wherein the ends 34 have been flattened into a pair of roughly teardrop or oval shaped ears 35 which ears 35 are then pierced or punched to form holes 38 as shown in FIG. 4. The preform 30 is then progressively bent as shown in FIG. 5 and then reshaped into a final form of the eyelet 40 of the present invention. Such eyelet 40 is thus of a generally U-shaped overall configuration with a central lace engaging portion 42 having an inner surface 44 which is essentially semicircular in configuration. In addition, the ears 35 are positioned in spaced generally parallel disposition to each other such that the ears 35 are suitable for positioning over a portion of the flaps 12 through which the series of conventional openings 20 have been provided. The hole 38 of each eyelet 40 is then aligned with one of the flap openings 20, and a rivet 50 is positioned through the holes 38 and openings 20 and then the rivet 50 is expanded to position each of the eyelets 40 onto the flap 12 in the desired longitudinally-separated orientation thereon. The plane of the U-shaped body 32 of the eyelets 40 thus is positioned normal to, that is, in a plane 90 degrees to the general plane formed by the flaps, and the central lacing engaging central portion 42 of the eyelets extended beyond the flap edge 14 to which the eyelets are attached and thus over the gap 16. This unique positioning of the eyelets 40 as well as their unique configuration not only reduces the friction between the lacing 22 and the eyelets 40 but also reduces and/or eliminates the friction between the upper flap surface 13 and the lacing 22 common with prior art systems. The present system also enables the lacing 22 to be continuously pulled upwardly to tighten the flaps 12 without pausing to loosen or reposition the lacing 22 between the flap openings 20 and thus contributes to a smooth trouble-free operation with a high quality feel absent in prior art systems. It should also be noted that the lacing 22 is free to move back and forth along the inner surface arc of the central lace-engaging surface (see FIG. 10A) as when the lacings are pulled upwardly but towards one side of the foot or the other.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An improved lacing system for a shoe, said lacing system comprising a shoe having a tongue and a pair of closure flaps overlying said tongue wherein each of said flaps in turn having an inner edge wherein said inner edges are disposed in separated opposition to each other so as to define a variable width closure space, each of said flaps including a plurality of extended eyelets mounted in longitudinal separation thereon wherein said eyelets extend into said closure space, overlie said tongue and are positioned in lateral opposition to each other, each of said eyelets of an overall U-shaped configuration having a central semicircular portion defining a low friction inner surface lace engaging surface and a pair of leg portions each in turn terminating in a connector portion for connecting said eyelet to said flap, said eyelet semicircular portion having a circular cross-sectional configuration, said leg portions of each of said eyelets being parallel to each other and defining a single plane, each of said planes being positioned perpendicular to said flaps and said tongue, said system having a lacing having a longitudinal strand-like body and opposed ends crisscross threaded through said eyelets such that upward force applied to the lacing ends and generally perpendicular to said plane will enable the lacing body to smoothly engage the inner surface of said central portions and enable no snag tightening and loosening of said flaps.

2. The lacing system of claim 1, said connector portions of said eyelets being flattened ears each having a central opening wherein said ears are in parallel spaced opposition to each other and the central openings are aligned, said flaps including longitudinally spaced holes such that the ears of individual eyelets are positioned over the flap holes so as to receive a fastener such as a rivet.

3. The lacing system of claim 2, wherein said ears are parallel to said flaps.

4. An improved lacing system including eyelets in combination with a boot, said boot having a pair of flaps including spaced longitudinally oriented holes therein for receipt of said eyelets, said eyelets each having an overall U-shaped configuration having parallel legs and including a central lace engaging portion having a circular cross-section and wherein said legs terminate in flattened ears each in turn having a central opening adapted for alignment with the flap holes and connection to said flaps, said legs along with said central lace engaging portion defining a single plane, wherein each of said single planes are positioned perpendicular to said flaps, said central lace engaging portion being semi-circular and lying in the plane formed by said legs and thus adapted to receive a lacing positioned in normal disposition to said central lace engaging portion.

5. The improved lacing system of claim 1, each of said eyelets formed from an integral length of wire of circular cross-sectional configuration which is progressively bent and shaped to form said central and connector portions thereof.

* * * * *